US005393027A

United States Patent [19]

Koval et al.

[11] Patent Number: 5,393,027

[45] Date of Patent: Feb. 28, 1995

[54] CLOTHESLINE PROP APPARATUS

[76] Inventors: Samuel Koval; Jeanette Koval, both of 1731 Canal St. Rear, Northampton, Pa. 18067

[21] Appl. No.: 72,071

[22] Filed: Jun. 7, 1993

[51] Int. Cl.[6] ..... A47F 5/00

[52] U.S. Cl. ..... 248/353; 211/119.01

[58] Field of Search ..... 248/353; 211/119.01, 211/119.1, 119.02, 119.03

[56] References Cited

U.S. PATENT DOCUMENTS

| | | | |
|---|---|---|---|
| 121,167 | 11/1871 | Habecker | 248/353 |
| 358,819 | 3/1887 | Power | 211/119.1 |
| 1,374,609 | 4/1921 | Schell | 248/353 |
| 1,538,900 | 5/1925 | Loughlin | 248/353 |
| 1,991,087 | 2/1935 | Falcon | 211/119.1 X |
| 2,231,531 | 2/1941 | Epler | 248/353 |
| 2,500,060 | 3/1950 | Calim | 248/353 |
| 2,707,091 | 4/1955 | Reeder | 248/353 |
| 4,717,107 | 1/1988 | Servadio | 248/353 |

FOREIGN PATENT DOCUMENTS

| | | | |
|---|---|---|---|
| 1321230 | 6/1973 | United Kingdom | 248/353 |

*Primary Examiner*—J. Franklin Foss
*Attorney, Agent, or Firm*—E. Michael Combs

[57] ABSTRACT

A tubular shaft is arranged for supporting a clothesline, having a first end arranged for securement to an underlying support surface and a second end having a head member, with a T-shaped slot to receive the clothesline therewithin, and a cap arranged to receive the head to capture the clothesline within the cap and head structure.

4 Claims, 4 Drawing Sheets

CLOTHESLINE PROP APPARATUS

BACKGROUND OF THE INVENTION

1. Field of the Invention

The field of invention relates to clothesline support structure, and more particularly pertains to a new and improved clothesline prop apparatus arranged to provide for adjustment to a clothesline.

2. Description of the Prior Art

Clothesline support structure is available in the prior art, wherein U.S. Pat. No. 4,717,107 sets forth a locking pole arranged to secure a clothesline within spaced cooperative clamping jaws. U.S. Pat. No. 3,856,421 to Nogler sets forth a support pole for mounting scaffolds and the like, wherein U.S. Pat. No. 4,434,898 to McCarthy sets forth a clothesline mast structure for supporting clothesline members.

The instant invention attempts to overcome deficiencies of the prior art by providing for a clothesline prop structure arranged to support a clothesline during use thereof and in this respect, the present invention substantially fulfills this need.

SUMMARY OF THE INVENTION

In view of the foregoing disadvantages inherent in the known types of clothesline prop apparatus now present in the prior art, the present invention provides a clothesline prop apparatus wherein the same utilizes a pole member arranged to capture a clothesline at its uppermost end. As such, the general purpose of the present invention, which will be described subsequently in greater detail, is to provide a new and improved clothesline prop apparatus which has all the advantages of the prior art clothesline prop apparatus and none of the disadvantages.

To attain this, the present invention provides a tubular shaft arranged for supporting a clothesline, having a first end arranged for securement to an underlying support surface and a second end having a head member, with a T-shaped slot to receive the clothesline therewithin, and a cap arranged to receive the head to capture the clothesline within the cap and head structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do riot depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved clothesline prop apparatus which has all the advantages of the prior art clothesline prop apparatus and none of the disadvantages.

It is another object of the present invention to provide a new and improved clothesline prop apparatus which may be easily and efficiently manufactured and marketed.

It is a further object of the present invention to provide a new and improved clothesline prop apparatus which is of a durable and reliable construction.

An even further object of the present invention is to provide a new and improved clothesline prop apparatus which is susceptible of a low cost of manufacture with regard to both materials and labor, and which accordingly is then susceptible of low prices of sale to the consuming public, thereby making such clothesline prop apparatus economically available to the buying public.

Still yet another object of the present invention is to provide a new and improved clothesline prop apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
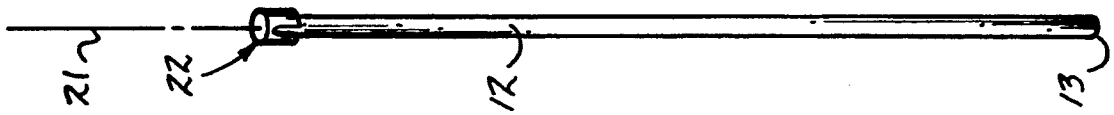
FIG. 2 is an isometric illustration of the shaft structure in an assembled configuration.

With reference now to the drawings, and in particular to FIGS. 1 to 13 thereof, a new and improved clothesline prop apparatus embodying the principles and concepts of the present invention and generally designated by the reference numeral 10 will be described.

Figure 1:
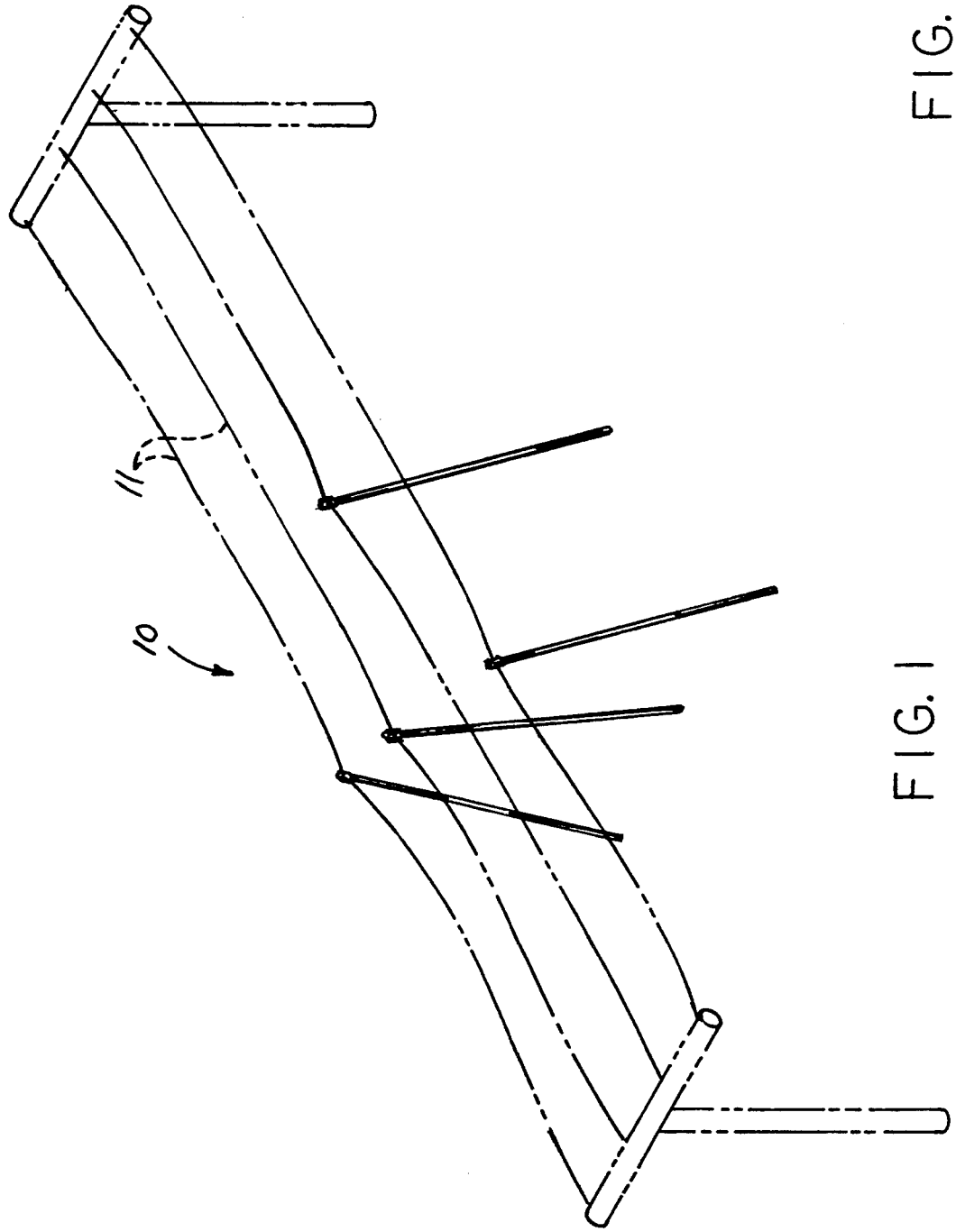
FIG. 1 is an isometric illustration of the invention in use.
Figure 3:
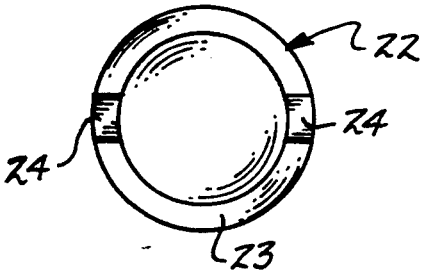
FIG. 3 is an orthographic bottom view of the cap member.
Figure 4:
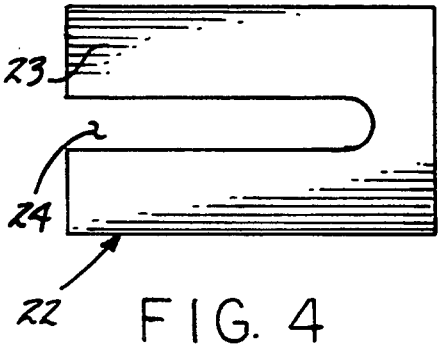
FIG. 4 is an orthographic side view of the cap member, as indicated in FIG. 3.
Figure 5:
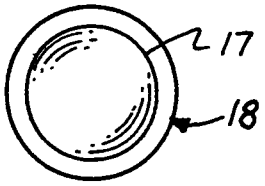
FIG. 5 is an orthographic bottom view of the second lug head arranged for reception within the uppermost end of the tubular shaft.
Figure 6:
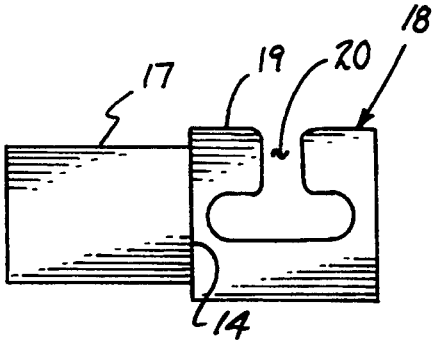
FIG. 6 is an orthographic side view of the second lug head as indicated in FIG. 5.
Figure 7:
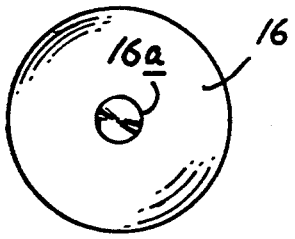
FIG. 7 is an orthographic bottom view of the lowermost end spike structure.
Figure 8:
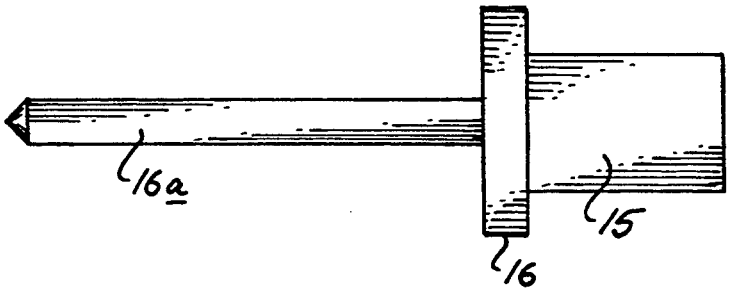
FIG. 8 is an orthographic side view of the spike structure as indicated in FIG. 7.
Figure 9:
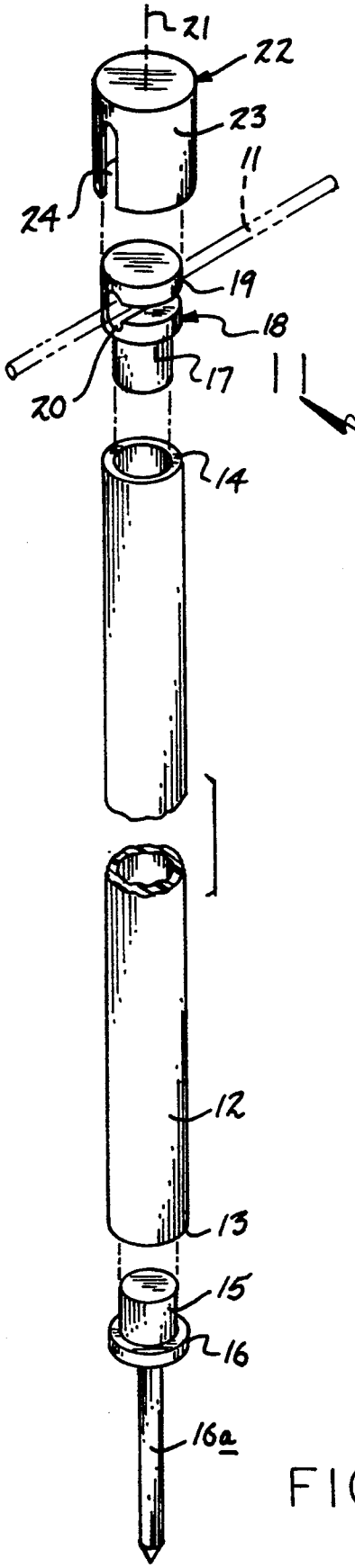
FIG. 9 is an isometric exploded illustration of the organization illustrating various components thereof.

More specifically, the apparatus 10 of the instant invention essentially comprises the supporting of a clothesline 11, such as indicated in FIG. 1, wherein typically such clotheslines are bowed by clothing and the like, wherein a shaft structure, such as indicated in FIG. 1, is provided to accommodate such bowing. To this end, a rigid tubular shaft 12 includes a first end 13 spaced from a second end 14, with the second end 14 at an uppermost end of the shaft structure, with a first lug 15 arranged for reception within the first end 13, having a first lug flange 16 mounted to the first lug for abutment with the second end 14, having a flange spike 16*a* projecting orthogonally relative to the flange 16 on an opposed side of the flange relative to the first lug 15. It should be noted that the spike 16*a* is coaxially aligned relative to the axis 21 of the organization symmetrically oriented relative to the shaft 12. Further, a second lug 17 is arranged for reception within the second end 14, having a second lug head 18, with the second lug head 18 including a second lug head side wall 19. A T-shaped slot 20 extends into the second lug head side wall 19, having an inner portion oriented medially of the second lug head 18 that is coaxially aligned along the axis 21 to receive the clothesline 11 therewithin, in a manner as indicated in FIG. 9 for example. To capture the clothesline 11 into the T-shaped slot, a cap 22 is provided having a cap cylindrical skirt 23 complementarily receiving the second lug head 18 therewithin. The skirt 23 includes a plurality of diametrically opposed slots 24 that are arranged parallel relative to one another and to the axis 21. In this manner, the clothesline 11 is received within the T-shaped slot 20, as well as the slots 24.

Figure 10:
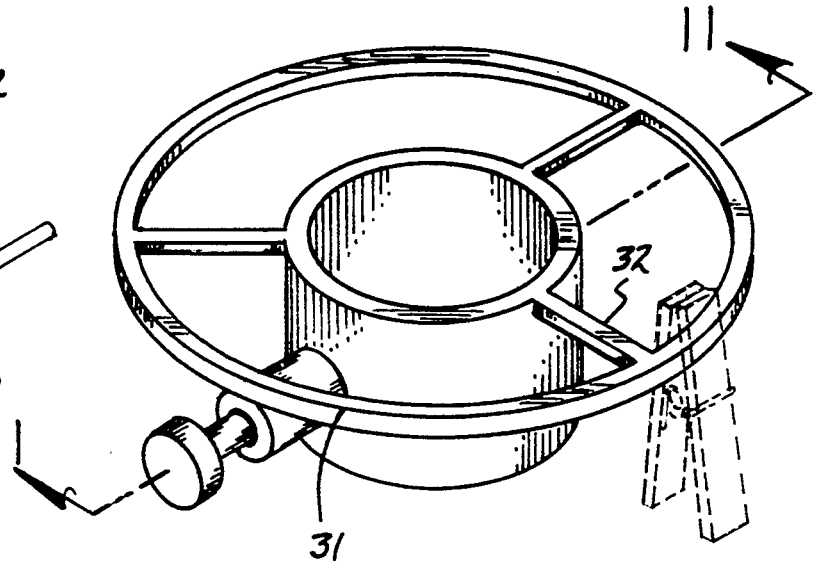
FIG. 10 is an isometric illustration of a clothespin support ring structure.
Figure 11:
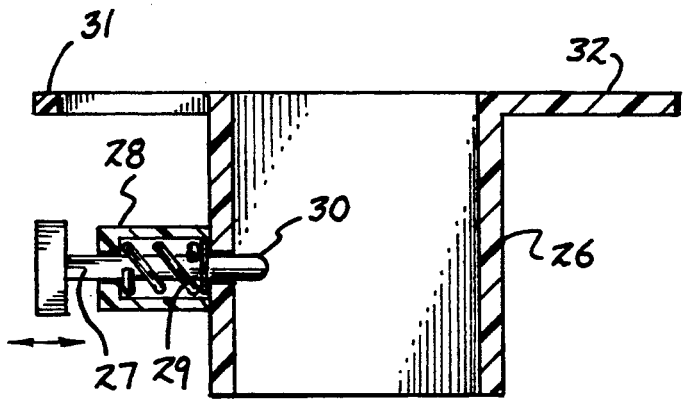
FIG. 11 is an orthographic view, taken along the lines 11—11 of FIG. 10 in the direction indicated by the arrows.
Figure 13:
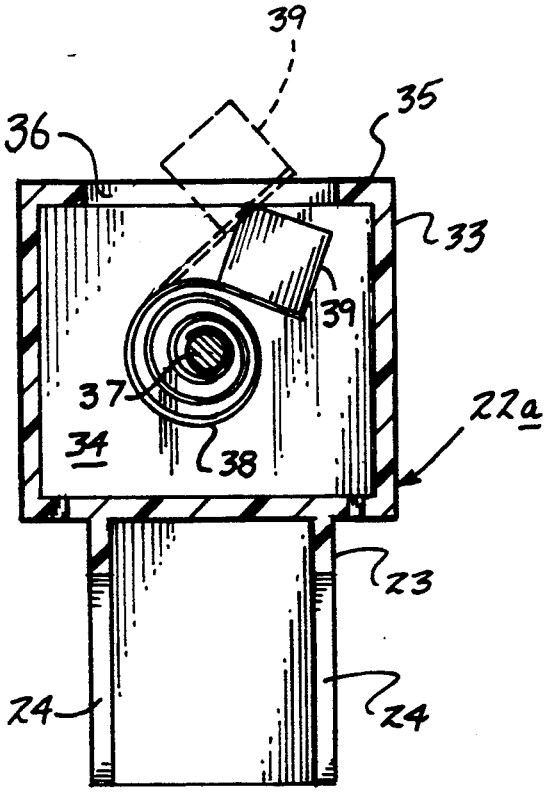
FIG. 13 is an orthographic view, taken along the lines 13—13 of FIG. 12 in the direction indicated by the arrows.

The FIGS. 10 and 11 indicate the, use of a mounting ring 31 arranged to accommodate clothespins thereon prior to their use relative to the clothesline structure 11. The mounting ring 31 includes a plurality of ribs 32 fixedly mounted to the ring 31 radially directed from the ring 31 into a support collar 26. The support collar 26 includes a locking leg 27 reciprocatably directed into the support collar 26 through a locking leg housing 28 fixedly mounted to an exterior surface of the support collar 26. A spring 29 is captured within the housing 28 and arranged in abutment between an outer end wall of the housing and an abutment plate 30 that is fixedly mounted to the locking leg 27 to bias the locking leg projecting interiorly of the support collar 26 for reception with one of a linear array of shaft apertures 25 (see FIG. 12) that are arranged in a parallel relationship relative to the axis 21.

Figure 12:
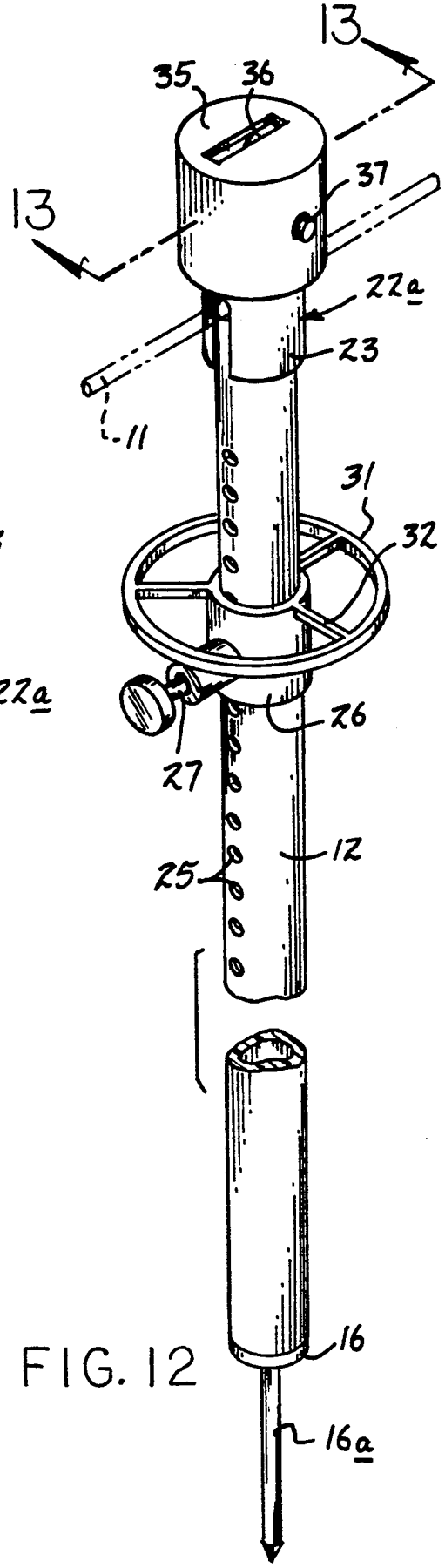
FIG. 12 is an isometric illustration of the use of a modified shaft structure having the clothespin ring structure mounted thereto.

The apparatus as indicated in FIG. 12 further includes a modified cap 22*a*, having a cap housing 33 fixedly mounted to the skirt 23 such that the cap housing 33 includes a cap housing cavity 34 therewithin. The cap housing cavity 34 includes a cap top wall 35 having a slot 36 therethrough. A shaft 37 is directed diametrically through the cap housing 33 mounting a bimetallic spring 38 that in turn includes a flag 39 fixedly mounted to a free outer end of the bimetallic spring 38. Upon temperatures elevating in use of the organization, the flag 39 that is aligned with the top wall slot 36 is directed through the top wall slot, in a manner as indicated in phantom in FIG. 13, to indicated ambient temperature at a desired level relative to drying of clothes upon the clothesline.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A clothesline prop apparatus arranged for supporting a clothesline, wherein the apparatus comprises, a rigid tubular shaft, having a first end spaced from a second end, wherein the shaft is coaxially aligned about an axis, with a first lug arranged for reception within a first end, with the first lug having a first lug flange arranged for abutment with the first end, and a spike fixedly mounted to the first lug flange projecting beyond the first end, and a second lug arranged for reception within the second end, the second lug having a second lug head, with the second lug head having a head side wall, the head side wall having a slot directed into the side wall, with the slot including a slot portion coaxially aligned along the axis for reception of the clothesline, a cap arranged for complementarily receiving the second lug head therewithin, the car having a cap skirt arranged for receiving the second lug head therewithin, the cap skirt having a plurality of diametrically opposed side wall slots, wherein the slots are arranged parallel and coextensive relative to one another for receiving the clothesline when the clothesline is directed through the slot.

2. An apparatus as set forth in claim 1 wherein the slot is of a T-shaped configuration.

3. An apparatus as set forth in claim 1 including a linear array of shaft apertures directed through the shaft between the first and second ends, and a support collar arranged for receiving the shaft therethrough, the support collar having a locking leg reciprocatably mounted through the support collar, wherein the locking leg includes a locking leg housing receiving the locking leg therethrough, and a spring mounted within the housing, and the locking leg having an abutment plate, wherein the spring is captured between the abutment plate and the housing to bias the locking leg within the support collar for reception within one of the shaft apertures, with a mounting ring arranged in surrounding relationship relative to the collar, including at least one rib member radially directed from the mounting ring to the collar for supporting the mounting ring in a spaced relationship about the collar, wherein the mounting ring is arranged for supporting clothespin members thereon.

4. An apparatus as set forth in claim 3 wherein the cap includes a cap housing extending beyond and above the skirt, with the cap housing having a cap housing cavity, and the cap housing further having a cap housing top wall, with the cap housing cavity oriented between the cap housing top wall and the cap skirt, the cap housing top wall having a top wail slot directed therethrough, and a shaft diametrically directed through the cap housing within the cap housing cavity, having a bimetallic spring wound thereabout, with the bimetallic spring having a bimetallic spring free end spaced from the shaft, and a flag mounted to the free end, with the flag arranged for projection through the slot upon ambient temperatures about the bimetallic spring elevated for effecting and cooling of the bimetallic spring about the shaft.

* * * * *